US010654639B2

(12) United States Patent
Ho

(10) Patent No.: US 10,654,639 B2
(45) Date of Patent: May 19, 2020

(54) CONTAINER COVER THAT FACILITATES CREATING NEGATIVE PRESSURE AND LONG TIME SEALING

(71) Applicant: Shin Hung Yih Technology Co., Ltd., Taipei (TW)

(72) Inventor: Yi-Hung Ho, Taipei (TW)

(73) Assignee: SHIN HUNG YIH TECHNOLOGY CO., LTD., Taipei (TW)

( * ) Notice: Subject to any disclaimer, the term of this patent is extended or adjusted under 35 U.S.C. 154(b) by 0 days.

(21) Appl. No.: 16/390,045

(22) Filed: Apr. 22, 2019

(65) Prior Publication Data

US 2019/0248564 A1 Aug. 15, 2019

Related U.S. Application Data

(63) Continuation of application No. 15/469,706, filed on Mar. 27, 2017, now Pat. No. 10,507,965.

(30) Foreign Application Priority Data

Jul. 5, 2016 (TW) ..... 105210104 A

(51) Int. Cl.
*B65D 81/20* (2006.01)
*B65D 21/02* (2006.01)
(Continued)

(52) U.S. Cl.
CPC ..... *B65D 81/2038* (2013.01); *B65D 21/0219* (2013.01); *B65D 43/26* (2013.01);
(Continued)

(58) Field of Classification Search
CPC .... B65D 45/32; B65D 43/0202; B65D 53/02; B65D 21/0209; B65D 51/1683; B65D 81/2038; B65D 43/26; B65D 45/02
See application file for complete search history.

(56) References Cited

U.S. PATENT DOCUMENTS 5,944,212 A ‡ 8/1999 Chang ..... B65D 81/2038 215/228
6,994,227 B2 ‡ 2/2006 Kwon ..... A47J 47/10 116/309
(Continued)

*Primary Examiner* — Timothy P. Kelly
(74) *Attorney, Agent, or Firm* — Demian K. Jackson; Jackson IPG PLLC

(57) ABSTRACT

A container cover for storage container includes a rotary device, an outer cover member, an inner cover member, a first guide block, second guide block, a pumping piston and a piston seat so arranged that when the rotary device is driven by a user to rotate the first guide block, guide rods of the first guide block are moved along a first continuous wave-shaped track of the second guide block, causing the second guide block and the pumping piston to move alternatively up and to further pump air out of the storage container through an air-pimping hole of the piston seat to create a negative pressure. Further, a first spring member an upper rail seat can be provided to balance the movement of the pumping piston and to stabilize the rotation of the first and second guide blocks. A relief valve rod can be selectively used for giving a visual indication indicative of the presence of a negative pressure in the storage container.

3 Claims, 17 Drawing Sheets

(51) Int. Cl.

| | |
|---|---|
| ***B65D 43/26*** | (2006.01) |
| ***B65D 45/02*** | (2006.01) |
| ***B65D 53/02*** | (2006.01) |
| ***B65D 79/00*** | (2006.01) |
| ***B65D 81/24*** | (2006.01) |

(52) U.S. Cl.
CPC ..... *B65D 45/02* (2013.01); *B65D 53/02* (2013.01); *B65D 79/005* (2013.01); *B65D 81/24* (2013.01); *B65D 2543/00018* (2013.01)

(56) References Cited

U.S. PATENT DOCUMENTS 10,053,266 B2 ‡ 8/2018 Ho ..... B65D 45/32
10,138,046 B2 ‡ 11/2018 Ho ..... B65D 81/2038
10,507,965 B2 * 12/2019 Ho ..... B65D 45/02

* cited by examiner
‡ imported from a related application

CONTAINER COVER THAT FACILITATES CREATING NEGATIVE PRESSURE AND LONG TIME SEALING

BACKGROUND OF THE INVENTION

1. Field of the Invention

The present invention relates to negative pressure storage container technology and more particularly, to a container cover that enables a pumping piston to pump air out of a container on which the container cover is covered after the user rotates a rotary device.

2. Description of the Related Art

U.S. Pat. No. 9,296,542, issued to the present inventor, discloses a vacuum storage container, which includes a container housing, a drawer mounted in the container housing and movable between a closed position and an open position, a rotary knob pivotally mounted in a door cover of the drawer, clockwork coupled to the rotary knob, a drive gear affixed to the rotary knob, a transmission gear set rotatable by the drive gear, an eccentric wheel rotatable by the transmission gear set, a pumping pump mounted in the drawer and coupled to the eccentric wheel for creating a vacuum in the container housing, an ejection mechanism adapted for ejecting the drawer out of the container housing, and an operating member control mechanism adapted for locking the drawer to the container housing and operable to unlock the drawer for enabling the drawer to be ejected out of the container housing by the ejection mechanism. Since the transmission gear set is arranged in a transverse direction, if you want to use the container cover in a cylindrical can, a barrel or a bottle-like container, the container cover will occupy a large transverse space of the container.

Further, in the use of a conventional mechanical type vacuum storage container, when the internal air of the storage container leaks out, the storage container cannot be automatically inflated. There are electronic type negative pressure storage containers commercially available. However, if the internal air of an electronic type negative pressure storage container leaks out, a vacuum pumping operation must be performed again, bringing inconvenience.

In addition, if the wine in a decanter is not finished soon, it is easy to oxidize and to mature quickly and clumsily, soon deteriorating into a worse state. Further, if a drink in a vessel is not finished, it is pity to discard the drink. Further, people may use a sealing container to store food ingredients. However, because the internal storage chamber of the sealing container is not maintained in a negative pressure status, the sealing container cannot keep the storage food ingredients fresh for long.

SUMMARY OF THE INVENTION

The present invention has been accomplished under the circumstances in view. It is therefore the main object of the present invention to provide a container cover consisting of a rotary device, an outer cover member, an inner cover member, a first guide block, second guide block, a pumping piston and a piston seat, and adapted for covering a storage container. The component parts are so arranged that when the rotary device is driven by a user to rotate the first guide block, guide rods of the first guide block are moved along a first continuous wave-shaped track of the second guide block, causing the second guide block and the pumping piston to move alternatively up and to further pump air out of the storage container through an air-pimping hole of the piston seat to create a negative pressure. Thus, the container cover of the invention has the characteristics of simple structure, space saving a wide application range.

Further, the container cover can be configured for covering a vacuum storage can, vacuum storage box, vacuum storage bottle, decanter, or any of a variety of storage containers of different shapes and sizes, facilitating creation of a negative pressure in the storage container. When a certain level of negative pressure is created in the storage container, the storage food ingredients and eatable items in the storage container can be maintained fresh, avoiding ruptured storage items due to moisture or oxidation.

Preferably, the container cover further comprises a relief valve rod. The relief valve rod has the top end thereof capped with a flexible end cap. When a negative pressure is created in the storage container, the flexible end cap will curve down, giving a visual indication of the presence of the negative pressure in the storage container.

DETAILED DESCRIPTION OF THE INVENTION

Figure 1:
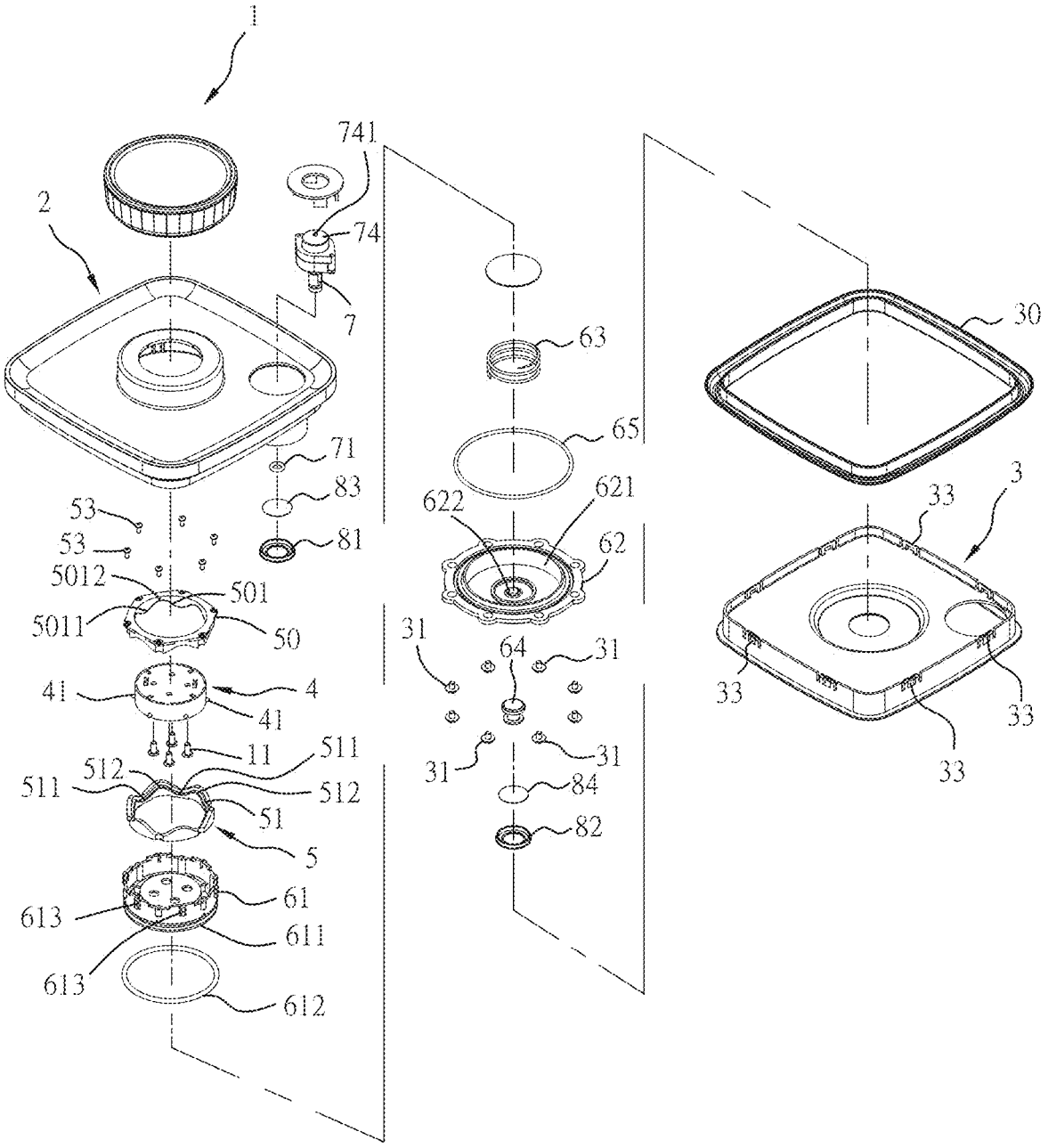
FIG. 1 is an exploded view of a container cover in accordance with a first embodiment of the present invention.

Referring to FIGS. 1-11, a container cover that facilitates creating negative pressure and long time sealing in accordance with a first embodiment of the present invention is shown. The container cover of this first embodiment comprises a rotary device 1, an outer cover member 2, an inner cover member 3, a first guide block 4, a second guide block 5, a pumping piston 61, and a piston seat 62, and a check valve 64.

The rotary device 1 in this embodiment is a rotary knob rotatably coupled to the outer cover member 2 and fastened to the first guide block 4 with a plurality of first fasteners 11 or other fastening means.

The outer cover member 2 is fixedly connected to the inner cover member 3 by means of latches (not shown) and mating latch holes 33 or other fastening means. Further, the outer cover member 2 has a plurality of axially extending guide grooves 22 (see FIG. 8).

The inner cover member 3 is connected to the outer cover member 2 with a packing gasket 30 sealed therebetween so that when the inner cover member 3 is covered with the outer cover member 2 onto an opening 101 of a storage container 10 (see FIGS. 5-8). The storage container 10 can be kept in an airtight condition.

The first guide block 4 has a plurality of guide rods 41. The second guide block 5 has a first continuous wave-shaped track 51 disposed in contact with the guide rods 41. Thus, when the first guide block 4 is being rotated with the rotary device (rotary knob) 1, the guide rods 41 are moved along the first continuous wave-shaped track 51 of the second guide block 5, causing the second guide block 5 to be moved up and down. Further, the second guide block 5 fastened to the pumping piston 61 with third fasteners 53 or other fastening means.

The pumping piston 61 comprises a plurality of constraint blocks 613 (see FIG. 2) respectively coupled to the axially extending guide grooves 22 of the outer cover member 2 (see FIG. 8) for vertical movement. The pumping piston 61 is adapted for reciprocation in a piston groove 621 of the piston seat 62 axially. The pumping piston 61 further comprises an external mounting groove 5 extended around the periphery thereof for the mounting of a first gasket ring 612.

Figure 4:
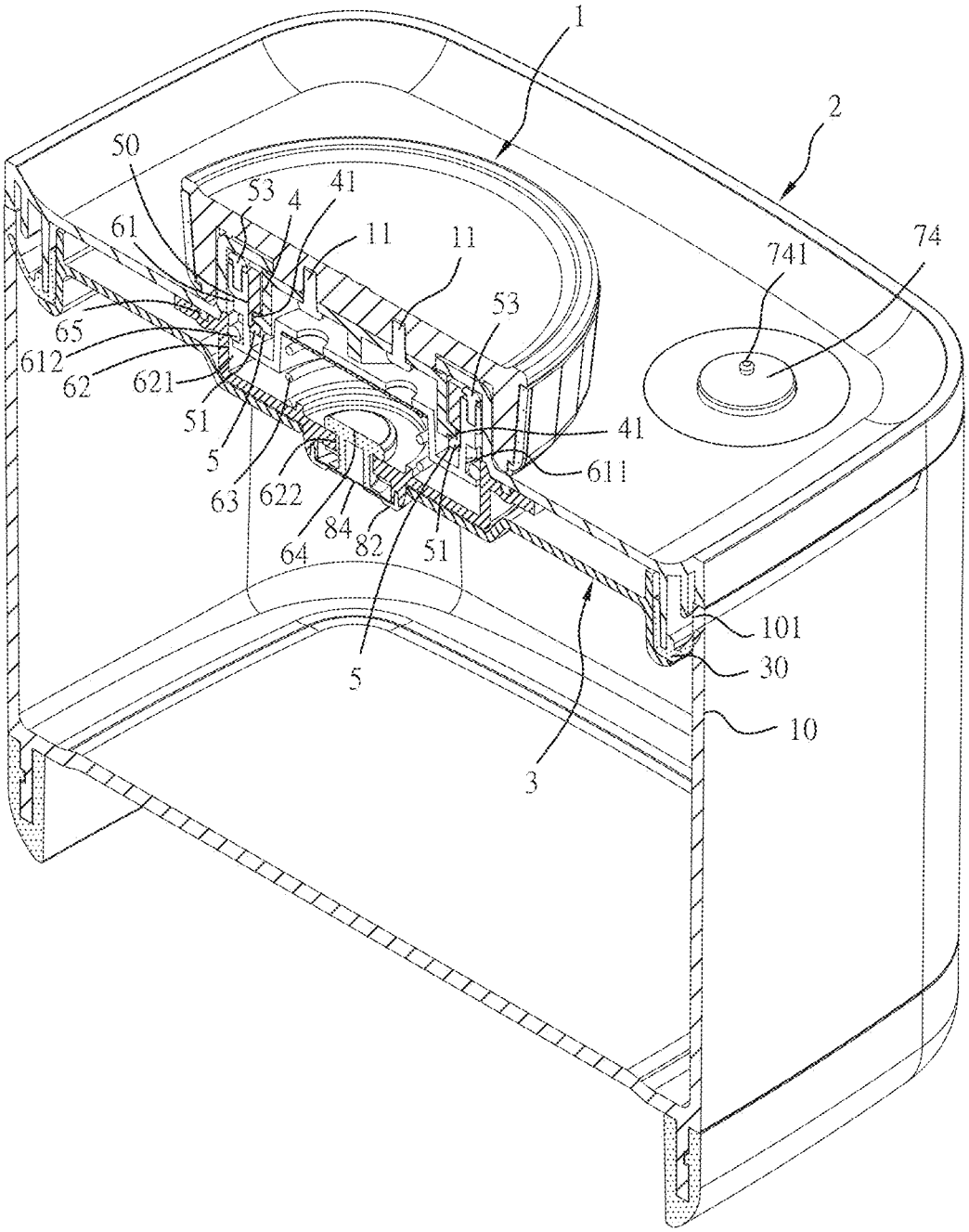
FIG. 4 is a sectional elevational applied view of the first embodiment of the present invention, illustrating the container cover covered a storage container.
Figure 5:
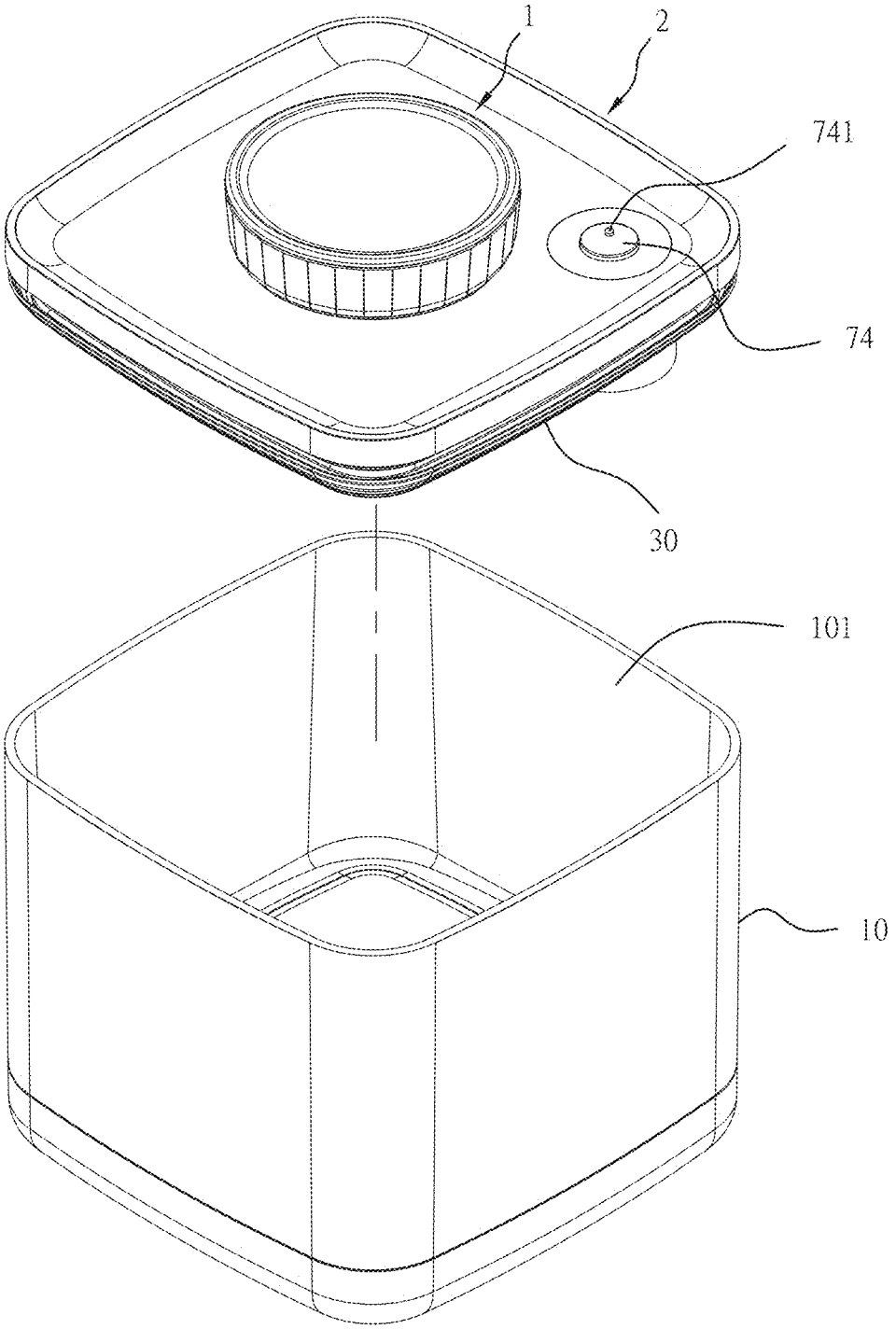
FIG. 5 is an exploded view of the container cover and the storage container in accordance with the first embodiment of the present invention.
Figure 6:
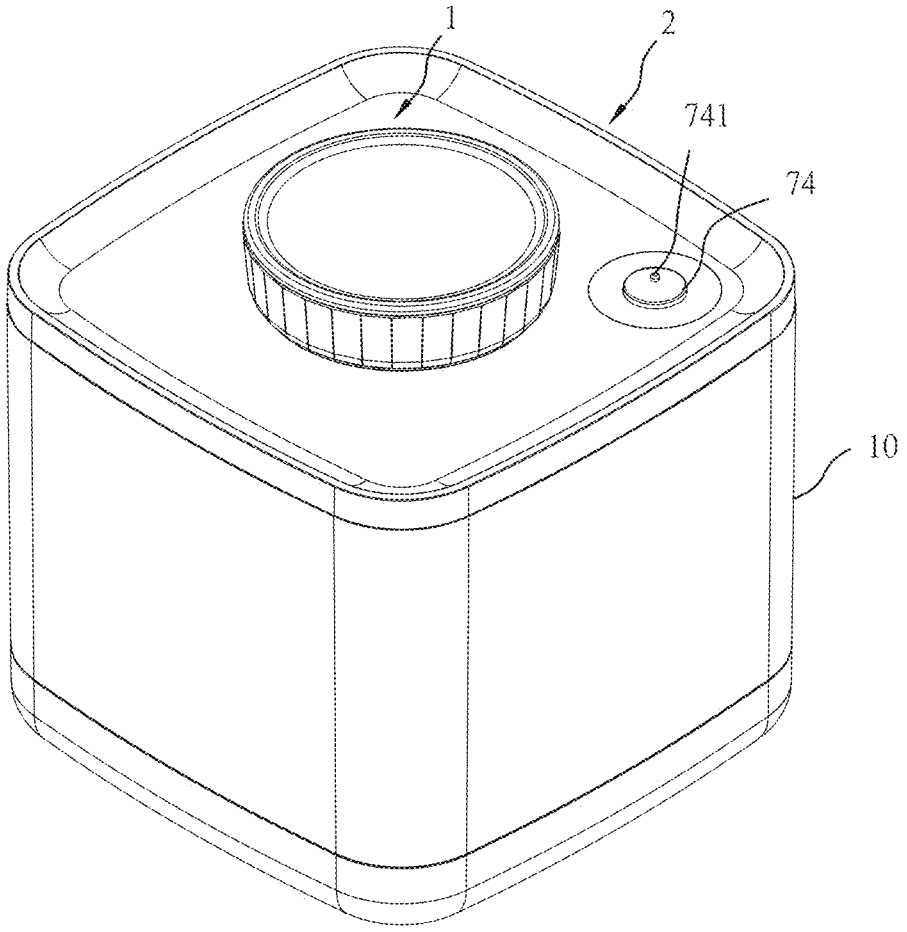
FIG. 6 is an oblique top elevational assembly view of FIG. 5.
Figure 7:
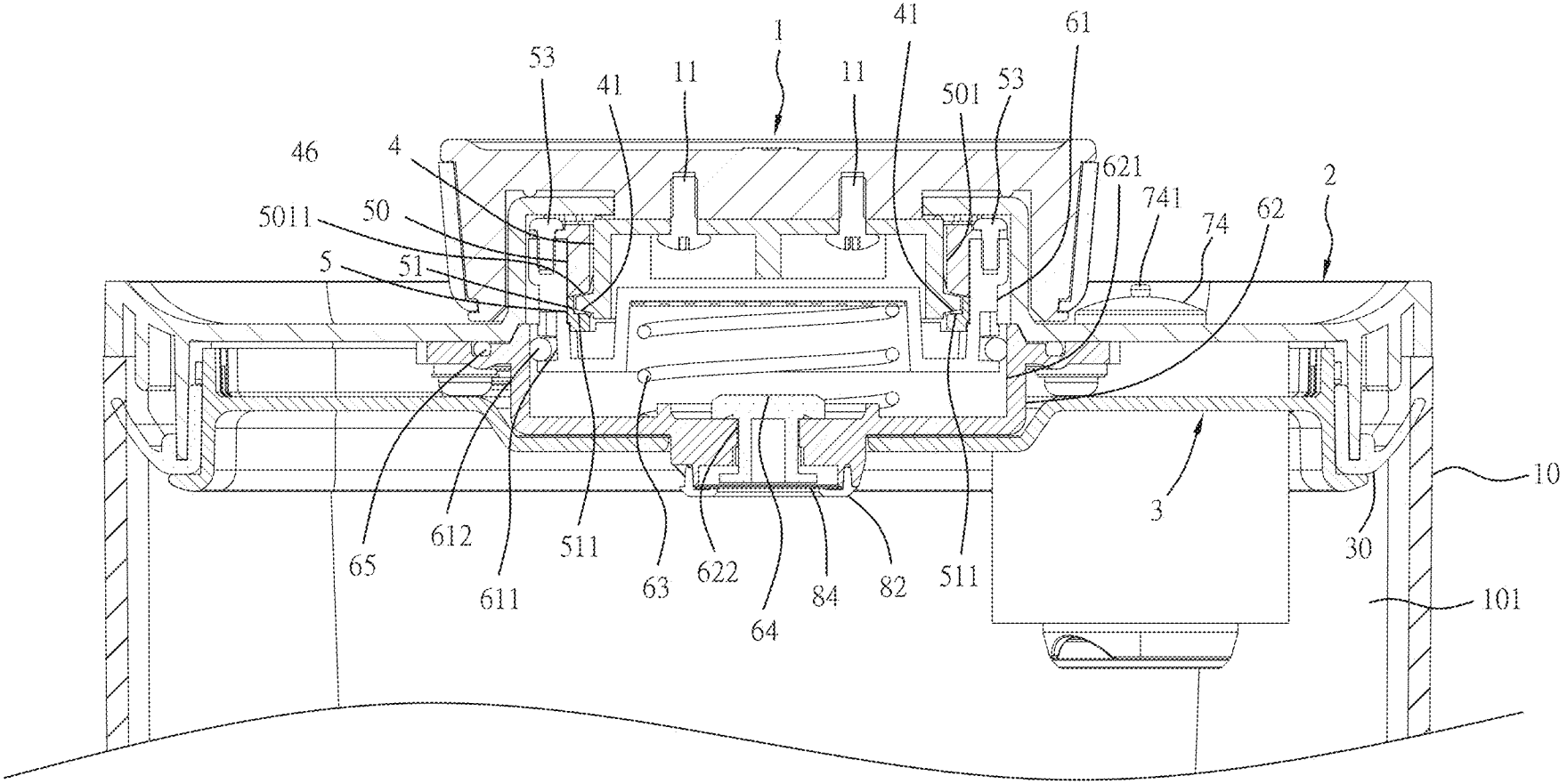
FIG. 7 is a schematic sectional view of a part of the first embodiment of the present invention, illustrating the guide rods disposed at the low-elevation points of the continuous wave-shaped track.
Figure 8:
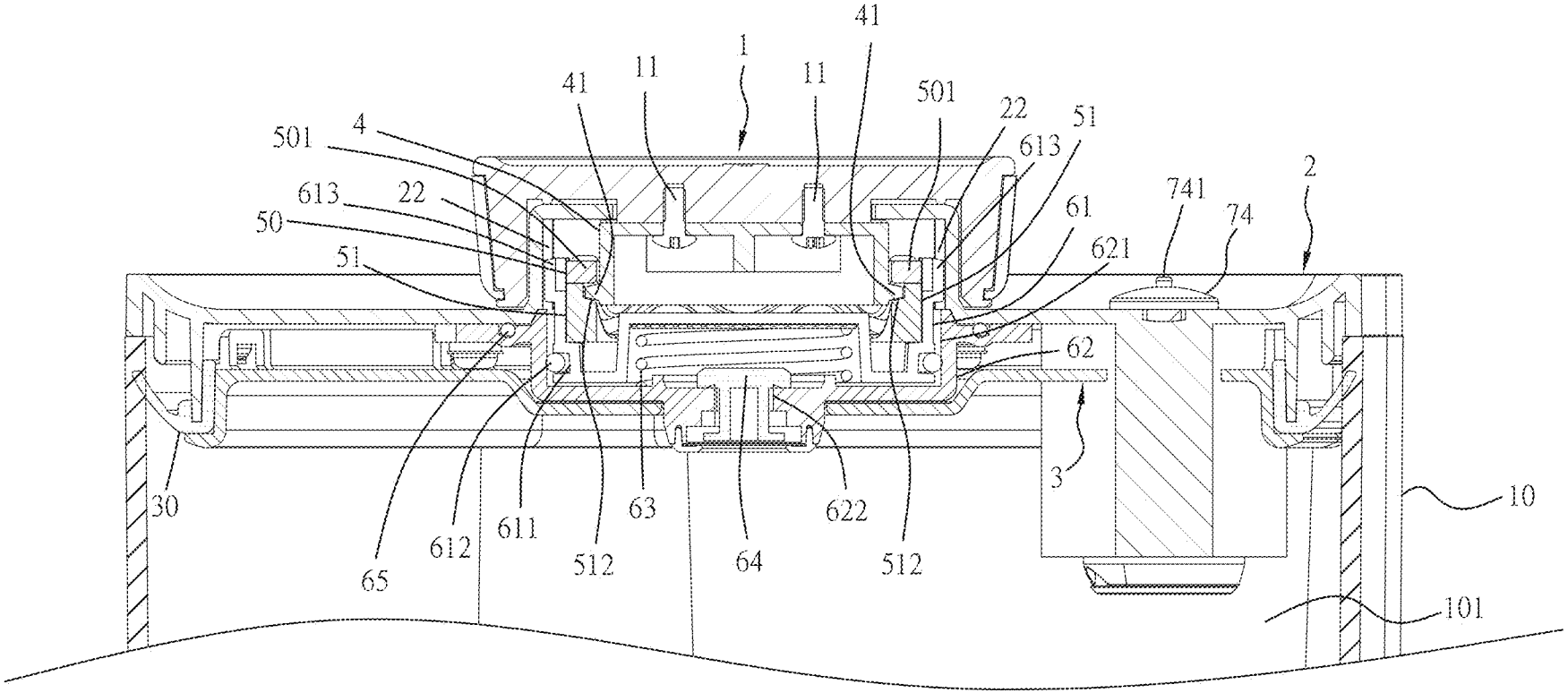
FIG. 8 is similar to FIG. 7, illustrating the guide rods disposed at the high-elevation points of the continuous wave-shaped track.

The piston seat 62 is fastened to the cover member 2 with a plurality of second fasteners 31 or other fastening means, comprising a piston groove 621 that accommodates the pumping piston 61 and allows the pumping piston 61 to reciprocate therein, a second gasket ring 65 mounted around the periphery thereof, and an air-pumping hole 622 cut through a bottom wall thereof (see FIG. 4 and FIGS. 7 and 8). The check valve 64 is mounted in the air-pimping hole 622.

Thus, when the user operates the rotary device (rotary knob) 1 to rotate the first guide block 4, the guide rods 41 of the first guide block 4 are moved along the first continuous wave-shaped track 51 of the second guide block 5, causing the second guide block 5 and the connected pumping piston 61 to move alternatively up and down along the piston groove 621 of the piston seat 62 (see FIGS. 7 and 8). During the reciprocating movement of the pumping piston 61, air is drawn out of the storage container 10 through the air-pimping hole 622 of the piston seat 62, causing reaction of a negative pressure in the storage container 10, and thus, the foods stored in the storage container 10 such as red wine, beverages, fruits, biscuits and other ingredients can be maintained fresh and well protected against oxidation.

The container cover further comprises a first spring member 63 supported between the pumping piston 61 and the piston groove 621 of the piston seat 62 (see FIGS. 7 and 8) to balance the axial movement of the pumping piston 61.

In the air-drawing stroke during the reciprocating motion of the piston 61, the load is heavy. On the contrary, in the return action during the reciprocating motion of the piston 61, the load is light. Subject to the arrangement of the first spring member 63, the user's hand can feel smooth when rotating the rotary device (rotary knob) 1.

Further, an upper rail seat 50 is fastened to the second guide block 5 and the pumping piston 61 by the aforesaid third fasteners 53. The upper rail seat 50 defines a second continuous wave-shaped track 501. The guide rods 41 of the first guide block 4 are supported between the second continuous wave-shaped track 501 of the upper rail seat 50 and the first continuous wave-shaped track 51 of the second guide block 5 for smooth movement.

Figure 2:
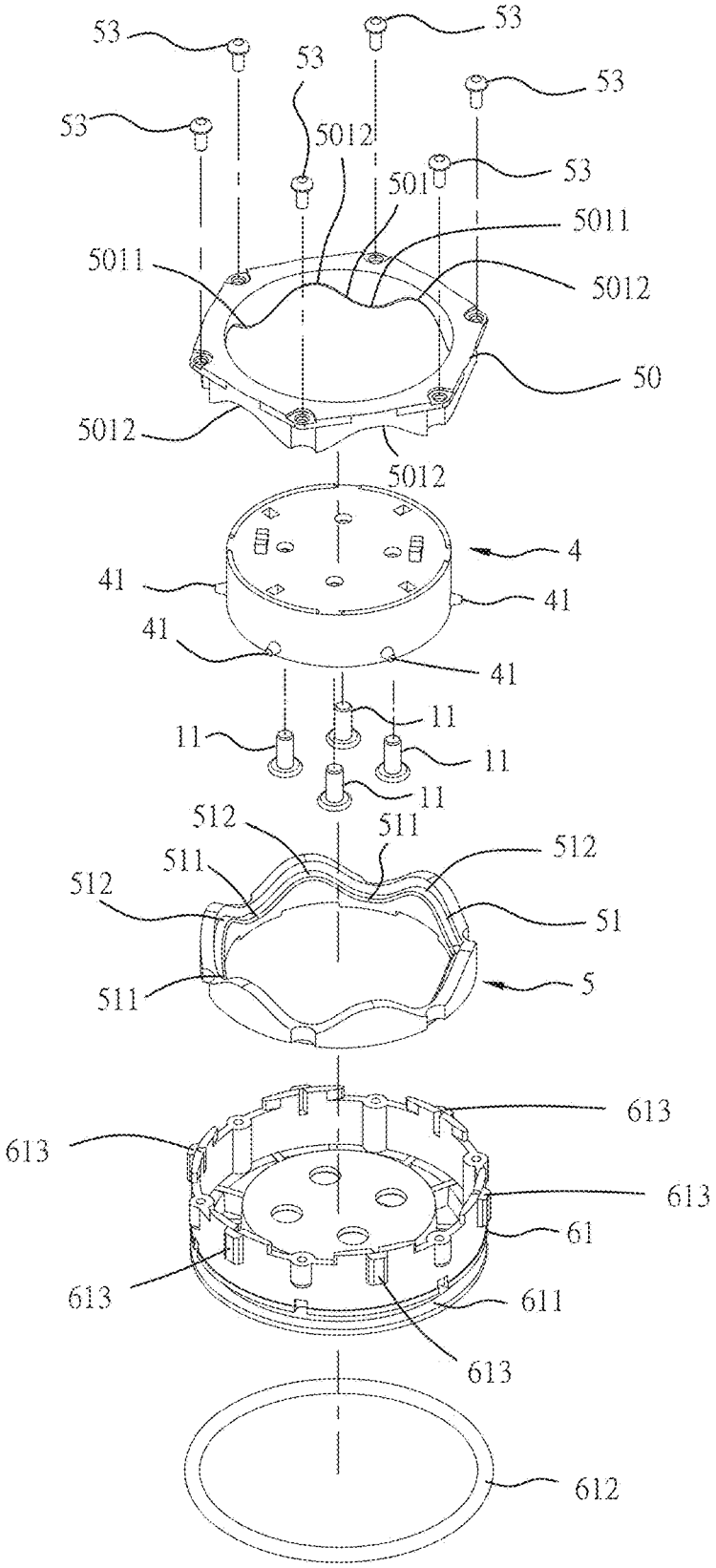
FIG. 2 is an enlarged view of a part of FIG. 2.
Figure 3:
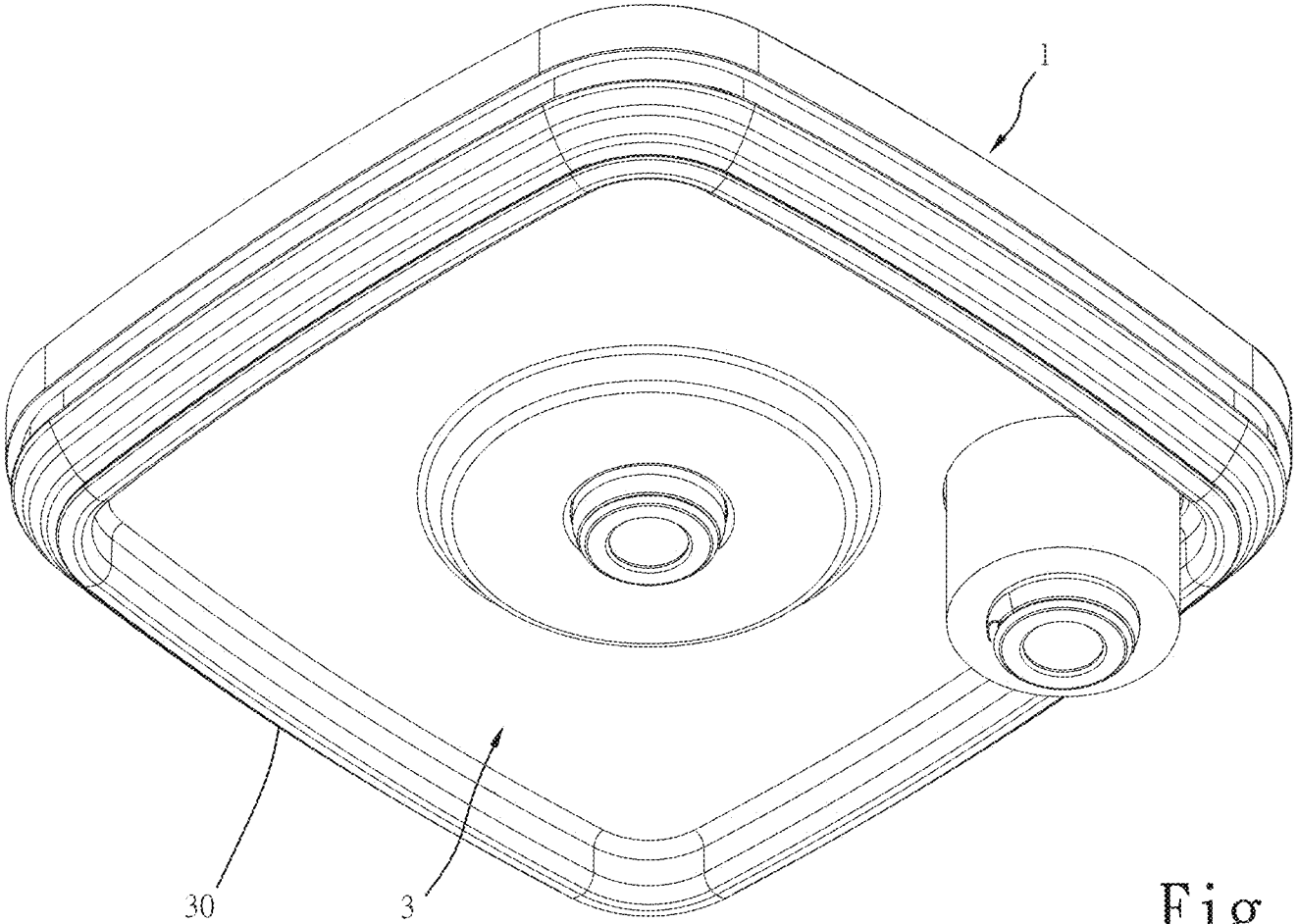
FIG. 3 is an oblique bottom elevational view of the container cover in accordance with the first embodiment of the present invention.

As illustrated in FIG. 2, the first continuous wave-shaped track 51 of the second guide block 5 comprises a plurality of low-elevation points 511 and a plurality of high-elevation points 512, wherein each low-elevation point 511 rises gradually to one respective high-elevation point 512; each high-elevation points 512 descends gradually to one respective low-elevation point 511.

Further, as illustrated in FIG. 2, the second continuous wave-shaped track 501 of the upper rail seat 50 comprises a plurality of low-elevation points 5011 and a plurality of high-elevation points 5012, wherein each low-elevation point 5011 rises gradually to one respective high-elevation point 5012; each high-elevation point 5012 descends gradually to one respective low-elevation point 5011.

Figure 9:
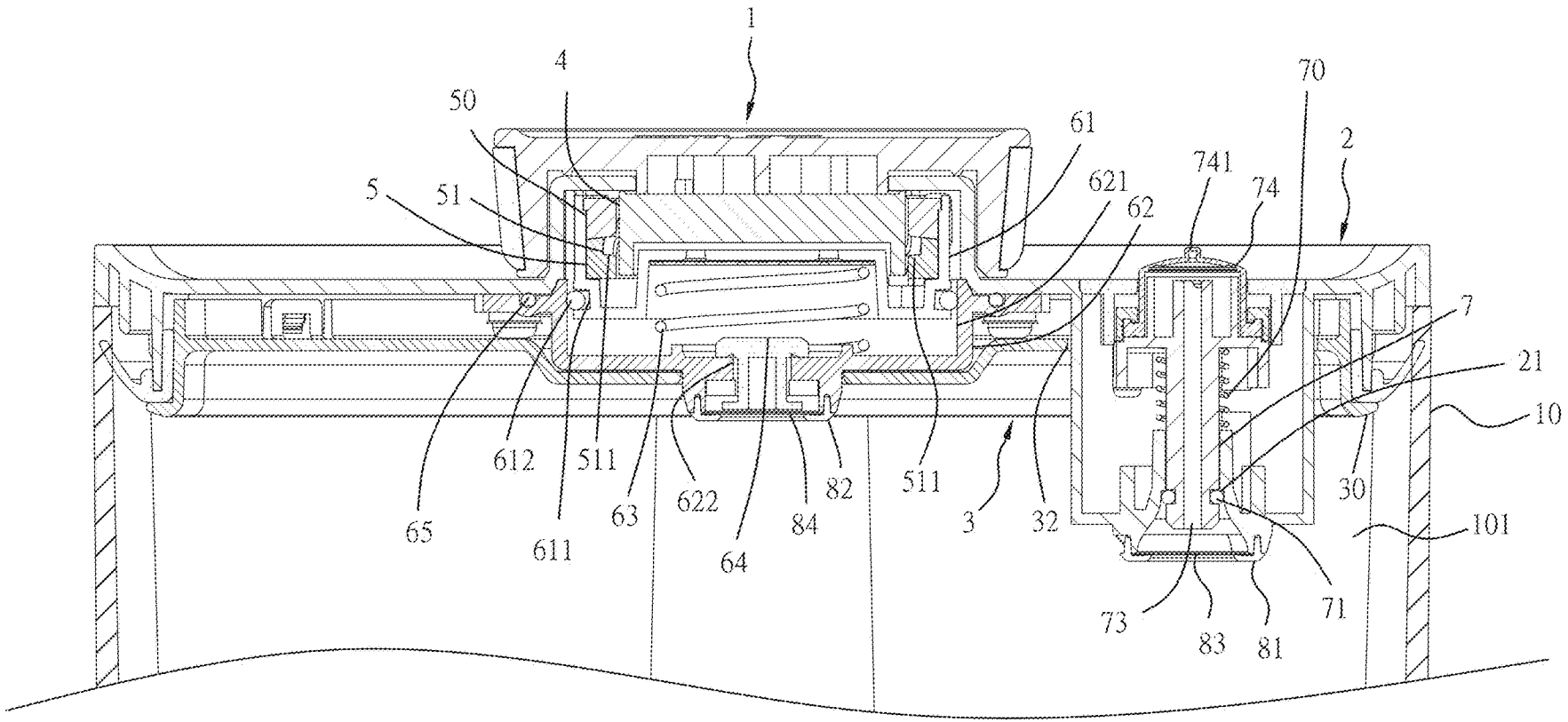
FIG. 9 is a schematic sectional view of the first embodiment of the present invention, illustrating the arrangement of the relief valve rod and the surrounding component parts.
Figure 10:
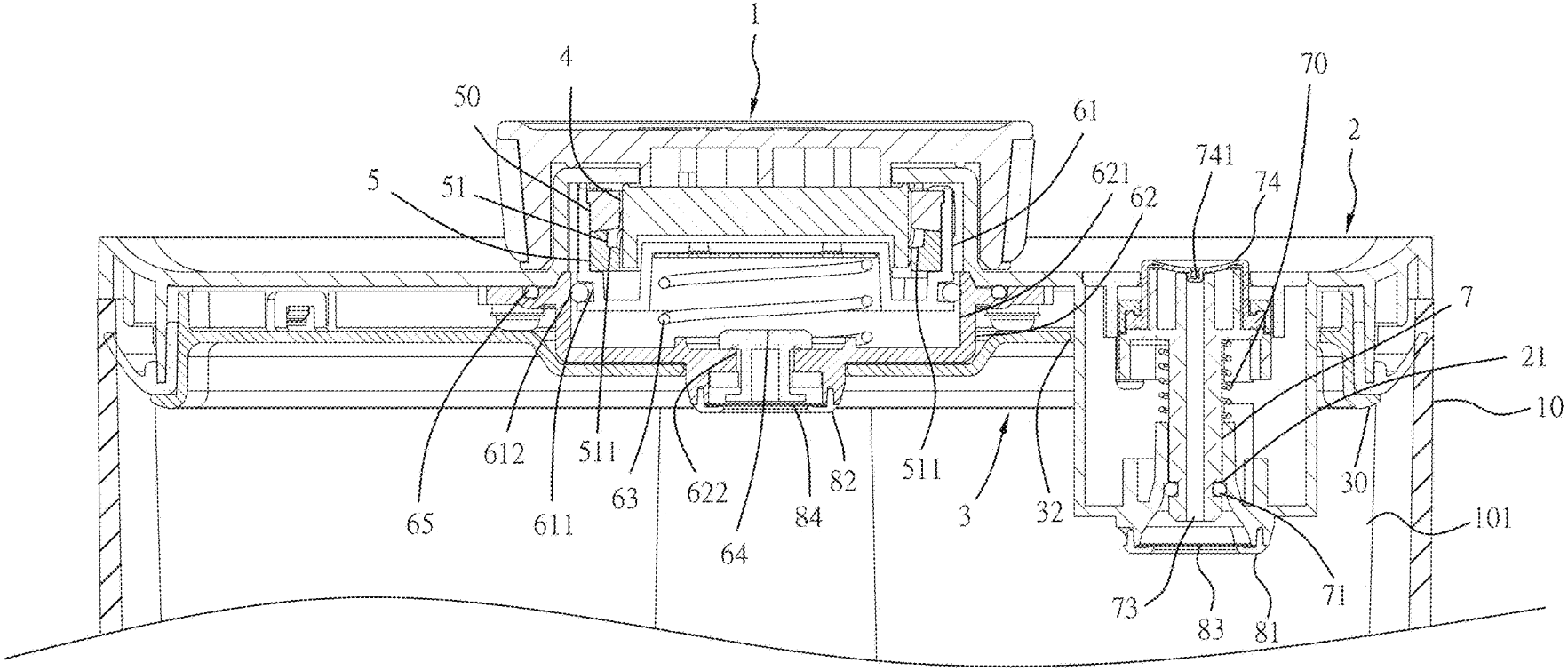
FIG. 10 corresponds to FIG. 9 after creation of a negative pressure in the storage container.
Figure 11:
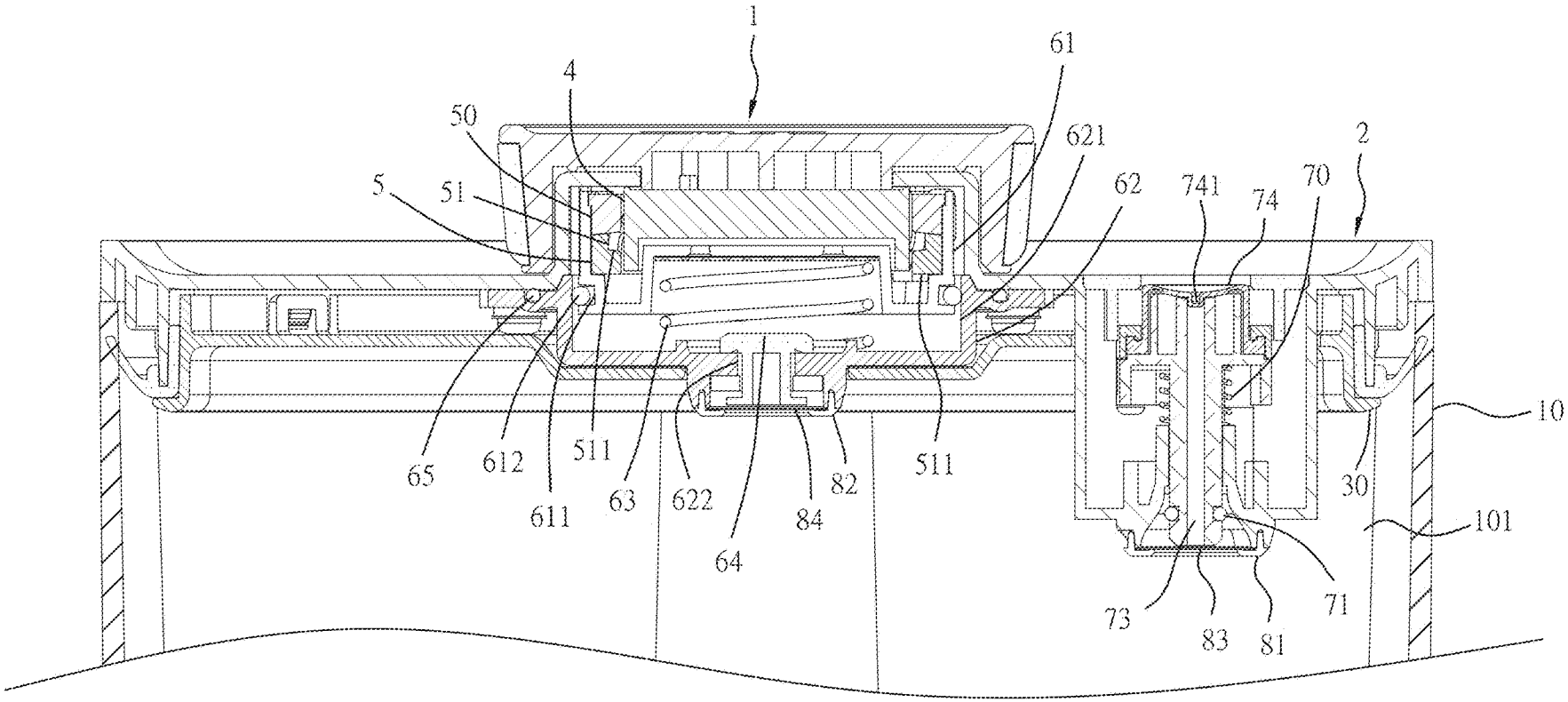
FIG. 11 corresponds to FIG. 9, illustrating the relief valve rod pressed down.

Further, as illustrated in FIGS. 9-11, the outer cover member 2 further comprises a relief hole 21 (see FIG. 9); the inner cover member 3 further comprises a through hole 32 (see FIG. 9) corresponding to the relief hole 21. Further, a relief valve rod 7 is mounted with a gasket ring 71, and movable to close the relief hole 21 of the outer cover member 2 (see FIGS. 9 and 10) or open relief hole 21 of the outer cover member 2 (see FIG. 11). Further, a second spring member 70 is mounted between the relief valve rod 7 and the relief hole 21 of the outer cover member 2, and adapted for imparting an elastic restoring energy to the relief valve rod 7 (see FIG. 10) to force the gasket ring 71 against the relief hole 21 of the outer cover member 2 when the container cover is capped on the storage container 10 and a negative pressure is created in the storage container 10. Further, when the relief valve rod 7 is pressed down by an external force (see FIG. 11), a gap is created between the gasket ring 71 and the relief hole 21 of the outer cover member 2 for discharge of the negative pressure. When the applied force is released from the relief valve rod 7, the elastic restoring energy of the second spring member 70 immediately pushes the relief valve rod 7 upward (see FIG. 9), forcing the gasket ring 71 to stop the relief hole 21. Further, the relief valve rod 7 has an internal channel 73 (see FIG. 9) extending through opposing top and bottom ends thereof. The internal channel 73 has the bottom end thereof disposed in communication with the relief hole 21 of the outer cover member 2, and the opposing top end thereof mounted with a flexible end cap 74 (see FIG. 9). Thus, when a negative pressure is created in the storage container 10 after the container cover covered the storage container 10, the flexible end cap 74 will curve down due to the presence of a suction force in the internal channel 73 (see FIG. 10). The downwardly curving condition of the flexible end cap 74 can be seen, giving a visual negative pressure indication for reference. The flexible end cap 74 has a top protrusion 741 made of a different material or in a different color relative to the body of the flexible end cap 74 for easy visual identification of the presence of a negative pressure in the storage container 10.

Figure 13:
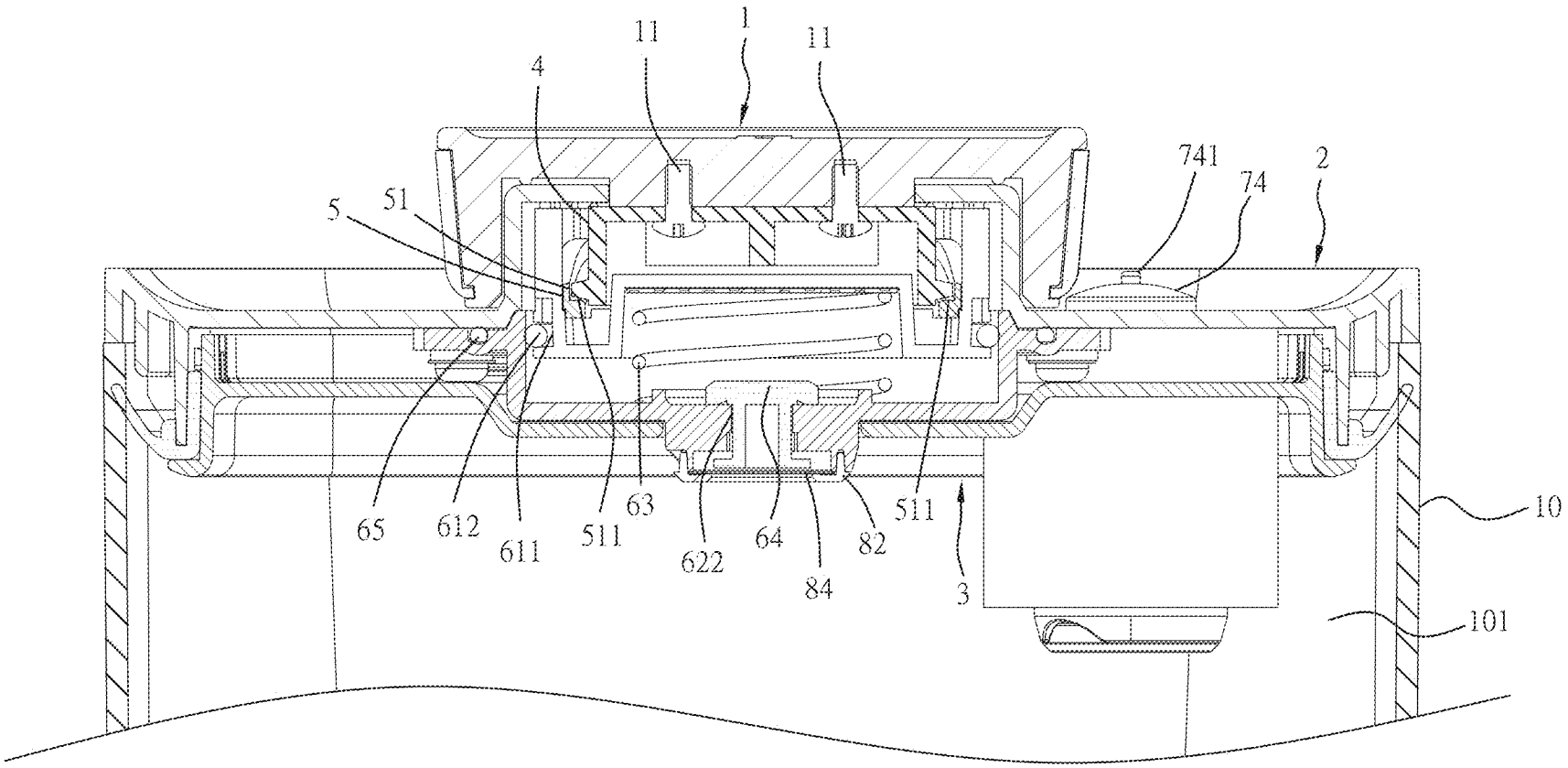
FIG. 13 is a schematic sectional view of the first embodiment of the present invention where the upper rail seat is eliminated.

Further, as illustrated in FIG. 1 and FIG. 9, dust ring caps 81,82 with respective anti-dust filter meshes 83,84 are respectively mounted in the relief hole 21 of the outer cover member 2 and the air-pimping hole 622 of the piston seat 62, avoiding powder content in the storage container 10 from affecting air tightness or product service life. Further, the dust ring caps 81,82 and the anti-dust filter meshes 83,84 are detachable for easy cleaning or replacement Referring to FIG. 13, in a modification of the first embodiment of the present invention, the aforesaid upper rail seat 50 is eliminated, achieving the same expected effects.

Figure 14:
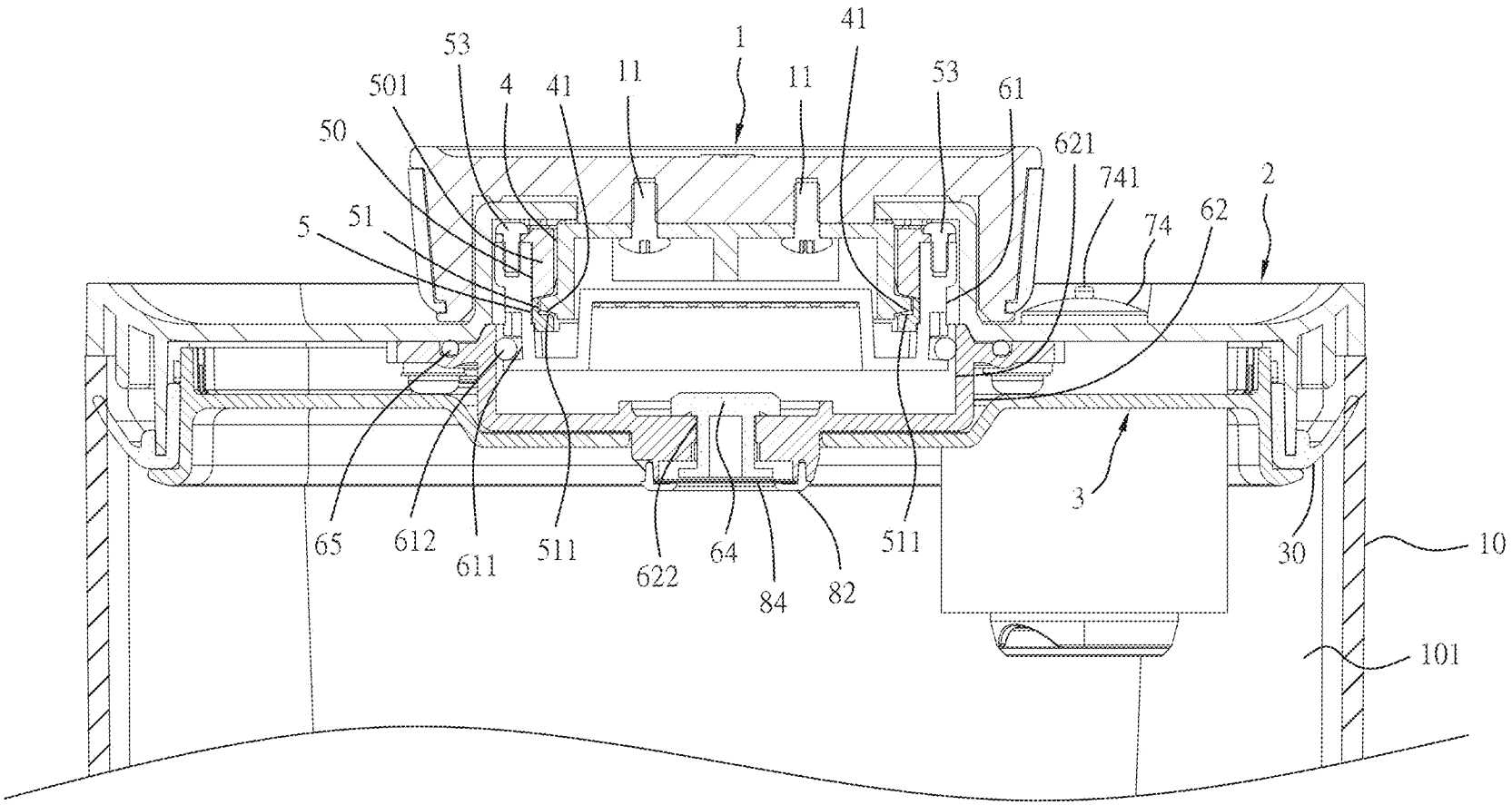
FIG. 14 is a schematic sectional view of the first embodiment of the present invention where the spring member is eliminated.

Referring to FIG. 14, in another modification of the first embodiment of the present invention, the first spring member 63 is eliminated, achieving the same expected effects.

Figure 15:
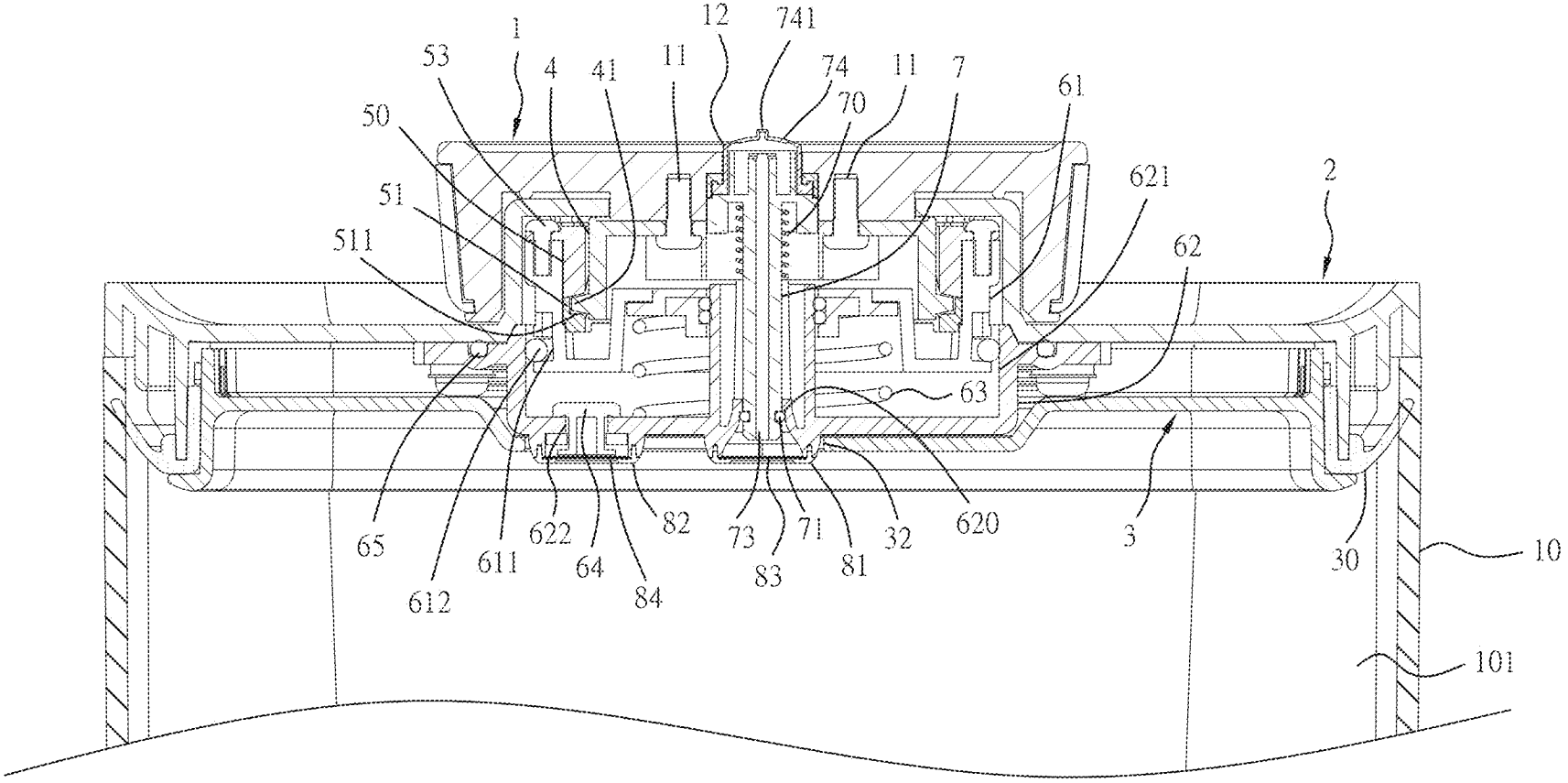
FIG. 15 is schematic sectional view of the first embodiment of the present invention, illustrating the position of the relief valve rod changed and the top end of the relief valve rod faced toward the rotary device.

Referring to FIG. 15, in still another modification of the first embodiment of the present invention, the relief valve rod 7 is disposed at a different location with the top end thereof facing toward a through hole 12 in the rotary device (rotary knob) 1. In this embodiment, the piston seat 6 further comprises a relief hole 620; the relief hole 620 of the piston seat 6 can be blocked or opened by the gasket ring 71 of the relief valve rod 7; a second spring member 70 is supported between the relief valve rod 7 and the relief hole 620 of the piston seat 6 to impart an elastic restoring energy to the piston seat 6, forcing the gasket ring 71 of the relief valve rod 7 into abutment against the relief hole 620 of the piston seat 6 after creation of a negative pressure in the storage container 10. Further, when the relief valve rod 7 is being held down by an external pressure, a gap is created between the gasket ring 71 and the relief hole 620 of the piston seat 6 for discharging air pressure. When released the downward pressure from the relief valve rod 7, the elastic restoring energy of the second spring member 70 immediately pushes the relief valve rod 7 upward, forcing the gasket ring 71 into abutment against the relief hole 620 again. The relief valve rod 7 has an internal channel 73 extending through opposing top and bottom ends thereof. The bottom end of the internal channel 73 is disposed in communication with the relief hole 620 of the piston seat 62. The opposing top end of the relief valve rod 7 is mounted with a flexible end cap 74. Thus, when a negative pressure is created in the storage container 10 after the container cover covered the storage container 10, the flexible end cap 74 will curve down due to a suction force in the internal channel 73 (see FIG. 10). The downwardly curving condition of the flexible end cap 74 can be seen, giving a visual negative pressure indication for reference. The flexible end cap 74 has a top protrusion 741 made of a different material or in a different color relative to the body of the flexible end cap 74 for easy identification of the presence of a negative pressure in the storage container 10.

Figure 16:
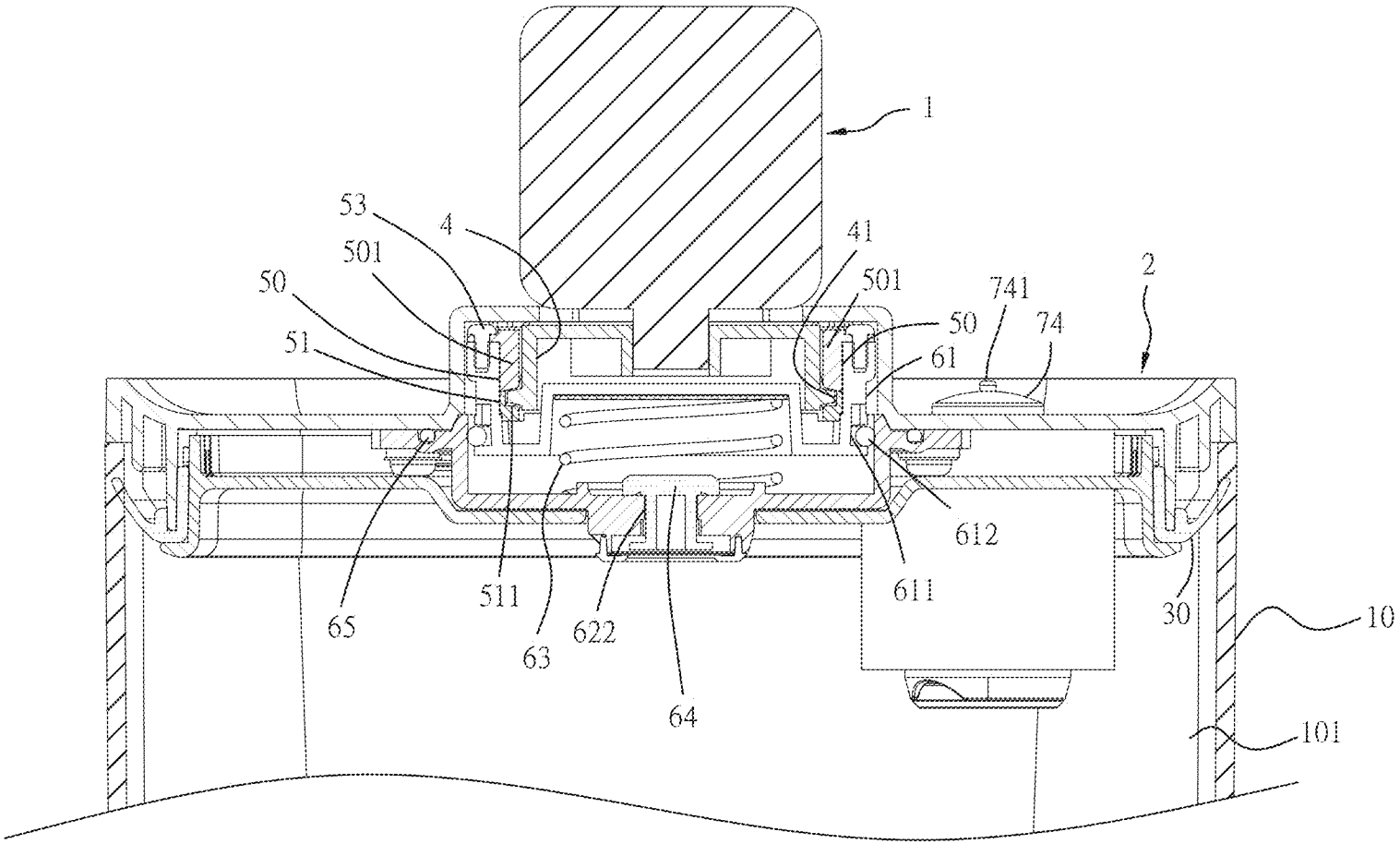
FIG. 16 is a schematic sectional view of a container cover in accordance with a second embodiment of the present invention.
Figure 17:
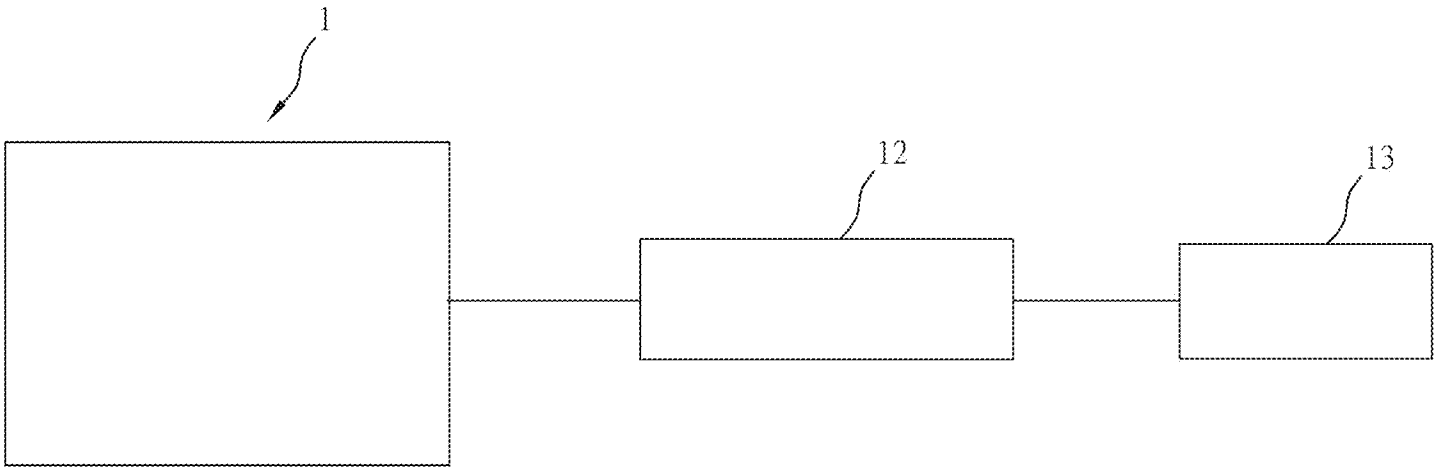
FIG. 17 is a circuit block diagram of the motor module, power supply module and switch control module of the second embodiment of the present invention.

Referring to FIGS. 16 and 17, a container cover that facilitates creating negative pressure and long time sealing in accordance with a second embodiment of the present invention is shown. The container cover of this second embodiment is substantially similar to the aforesaid first embodiment with the exception that the rotary device 1 in this second embodiment is a motor module. The rotary device (motor module) 1 is affixed to the first guide block 4 with fasteners (not shown). When the rotary device (motor module) 1 is driven to rotate the first guide block 4, the mating arrangement between the guide rods 41 of the first guide block 4 and the first continuous wave-shaped track 51 of the second guide block 5 causes the second guide block 5 and the pumping piston 61 to move alternatively up and down in the piston groove 621 of the piston seat 62, thereby drawing air out of the storage container 10 through the air-pimping hole 622 of the piston seat 62, and a negative pressure is thus created in the storage container 10.

Further, as illustrated in FIG. 17, the rotary device (motor module) 1 is electrically connected to a power supply module 12 (for example, battery set). The power supply module 12 is electrically coupled to a switch control module 13 that controls on/off of the rotary device (motor module) 1.

The other structural details and technical features are same as the aforesaid first embodiment. The only difference between the aforesaid first embodiment and this second embodiment is the use of a motor module for the rotary device 1. Since the contents of the second embodiment are the same as those of the first embodiment, we do not repeat them.

In conclusion, the invention has the features and effects as follows:

1. When rotating the rotary device 1, the mating arrangement between the guide rods 41 of the first guide block 4 and the first continuous wave-shaped track 51 of the second guide block 5 causes the second guide block 5 and the pumping piston 61 to move alternatively up and down in the piston groove 621 of the piston seat 62, thereby drawing air out of the storage container 10 to create a negative pressure is thus created in the storage container 10. Thus, the container cover of the invention has the characteristics of simple structure, space saving a wide application range.

Figure 12:
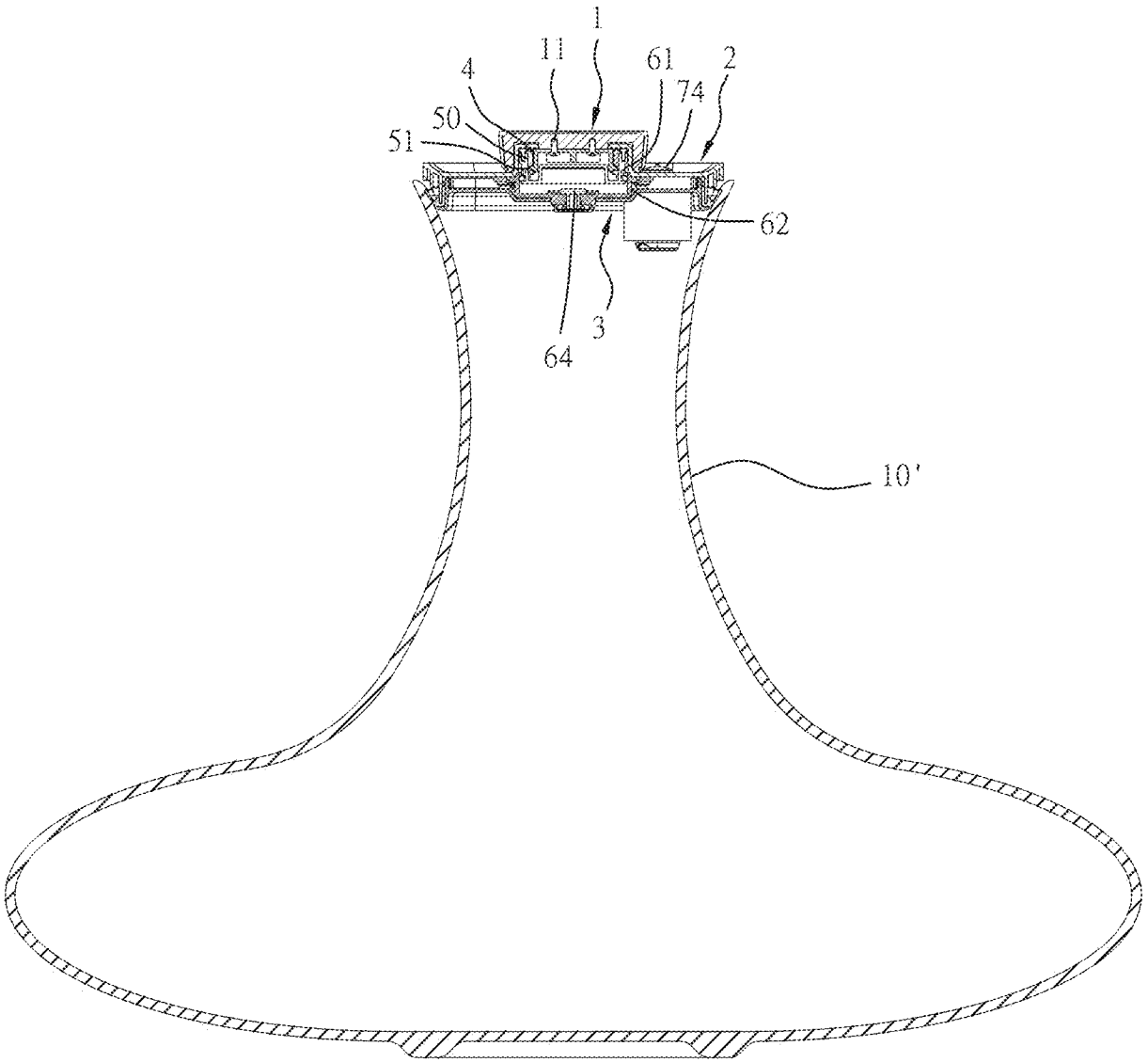
FIG. 12 is a schematic applied view of the first embodiment of the present invention, illustrating the container cover covered a decanter.

2. The container cover can be configured for covering a vacuum storage can, vacuum storage box, vacuum storage bottle, decanter, or any of a variety of storage containers of different shapes and sizes. FIG. 12 illustrates the container cover of the present invention capped on a decanter 10'.

3. When a certain level of negative pressure is created in the storage container 10, the storage food ingredients and eatable items in the storage container 10 can be maintained fresh, avoiding ruptured storage items due to moisture or oxidation.

4. When a negative pressure is created in the storage container 10, the flexible end cap 74 of the relief valve rod 7 will curve down, giving a visual indication of the presence of a negative pressure in the storage container 10; the flexible end cap 74 can be configured to provide a top protrusion 741 that is at the center of the top surface of the flexible end cap 74 and made of a different material in a different color relative to the flexible end cap 74, enhancing the negative pressure identification indication effect.

What is claimed is:

1. A container cover, comprising a rotary device, an outer cover member, an inner cover member, a first guide block, a second guide block, a pumping piston, a piston seat, a check valve and a first spring member, wherein:

said rotary device is rotatably coupled to said outer cover member and fixedly connected with said first guide block;

said outer cover member is fixedly connected to said inner cover member, said outer cover member comprising a plurality of axially extending guide grooves;

said inner cover member is mounted with a packing gasket, said packing gasket being set between said inner cover member and said outer cover member and adapted for sealing a container in an airtight manner when said outer cover member is covered with said inner cover member on said container;

said first guide block comprises a plurality of guide rods;

said second guide block is fixedly fastened to said pumping piston, comprising a first continuous wave-shaped track disposed in contact with said guide rods at a bottom side for causing said guide rods to move along said first continuous wave-shaped track of said second guide block and said second guide block to move up and down when said first guide block is rotated by said rotary device, said first continuous wave-shaped track of said second guide block comprising a plurality of low-elevation points and a plurality of high-elevation points, each said low-elevation point of said first continuous wave-shaped track rising gradually to one respective said high-elevation points of said first continuous wave-shaped track, each said high-elevation point of said first continuous wave-shaped track descending gradually to one respective said low-elevation point of said first continuous wave-shaped track;

said upper rail seat is fixedly fastened to said second guide block and said pumping piston, comprising a second continuous wave-shaped track disposed in contact with said guide rods of said first guide block at a top side, said second continuous wave-shaped track of said upper rail seat comprising a plurality of low-elevation points and a plurality of high-elevation points, each said low-elevation point of said second continuous wave-shaped track rising gradually to one respective said high-elevation points of said second continuous wave-shaped track, each said high-elevation point of said second continuous wave-shaped track descending gradually to one respective said low-elevation point of said second continuous wave-shaped track;

said pumping piston is adapted for reciprocation in a piston groove of said piston seat axially, comprising a plurality of constraint blocks respectively coupled to said axially extending guide grooves of said outer cover member for vertical movement and an external mounting groove extended around the periphery thereof and mounted with a first gasket ring;

said piston seat is fixedly fastened to said cover member, comprising a piston groove that accommodates said pumping piston and allows said pumping piston to reciprocate therein, a second gasket ring mounted around the periphery thereof, and an air-pumping hole cut through a bottom wall thereof;

said check valve is mounted in said air-pumping hole of said piston seat;

said first spring member is mounted between said piston seat and said pumping piston;

when said rotary device is driven by an external force to rotate said first guide block, said guide rods are moved along said first continuous wave-shaped track, causing said second guide block and said pumping piston to move alternatively up and down in said piston groove of said piston seat and to further pump air out of said container through said air-pumping hole of said piston seat.

2. The container cover as claimed in claim 1, wherein said piston seat further comprises a relief hole; the container cover further comprises a relief valve rod mounted with a gasket ring and alternatively movable back and forth to close or open said relief hole of said outer cover member, a second spring member mounted between said relief valve rod and said relief hole of said piston seat and adapted for imparting an elastic restoring energy to said relief valve rod to force the said gasket ring at said relief valve rod into tightly abutment against said relief hole of said piston seat when said container cover is capped on said container and a negative pressure is created in said container; when said relief valve rod is pressed down by an external force, a gap is created between the said gasket ring at said relief valve rod and said relief hole of said piston seat for discharge of said negative pressure; when the applied force is released from the said relief valve rod at said relief valve rod, the elastic restoring energy of said second spring member immediately pushes said relief valve rod upward to force the said gasket ring at said relief valve rod to stop said relief hole, said relief valve rod having an internal channel extending through opposing top and bottom ends thereof, said internal channel having the bottom end thereof disposed in communication with said relief hole of said piston seat and the opposing top end thereof mounted with a flexible end cap, said flexible end cap being caused to curve down when a negative pressure is created in said container after said container cover covered said container, said flexible end cap having a top protrusion made of a different material or in a different color relative to the body of said flexible end cap for quick visual identification of the presence of a negative pressure in said container.

3. The container cover as claimed in claim 1, wherein said rotary device comprises a motor module coupled with said first guide block, a power supply module electrically coupled to said motor module, and a switch control module electrically coupled to said power supply module for controlling on/off of said motor module.

* * * * *